United States Patent [19]

Sotheran

[11] 4,374,466

[45] Feb. 22, 1983

[54] GAS TURBINE ENGINE

[75] Inventor: Arthur Sotheran, Bristol, England

[73] Assignee: Rolls Royce Limited, London, England

[21] Appl. No.: 127,501

[22] Filed: Mar. 5, 1980

[30] Foreign Application Priority Data

Mar. 8, 1979 [GB] United Kingdom ..... 7908290

[51] Int. Cl.[3] ..... F23R 3/32; F23R 3/18

[52] U.S. Cl. ..... 60/39.36; 60/738; 60/749

[58] Field of Search ..... 60/749, 737, 738, 39.36

[56] References Cited

U.S. PATENT DOCUMENTS

| | | | |
|---|---|---|---|
| 3,800,527 | 4/1974 | Marshall et al. | 60/749 |
| 4,125,998 | 11/1978 | Barou et al. | 60/737 |
| 4,226,087 | 10/1980 | Spadaccini | 60/737 |
| 4,249,373 | 2/1981 | Sotheran et al. | 60/39.36 |

*Primary Examiner*—Robert E. Garrett

*Attorney, Agent, or Firm*—Stevens, Davis, Miller & Mosher

[57] ABSTRACT

A gas turbine engine comprises an annular combustion chamber (13) intended for low nitrogen oxide emission. The chamber has a pre-mixing section (20) in which an air-fuel mixture is brought to a significant degree of vaporization before issuing through a grill (22) at the end of the pre-mixing section into a main section (21) of the chamber. Pilot sections (18,19) at opposite sides of the pre-mixing section have outlets (28,29) through which burning mixture from the pilot sections is discharged into main section (21). The grill (22) defines openings (35) through which the fresh mixture from the pre-mixing section (20) is discharged across the outlets (28,29) of the pilot sections (18,19) to mix with and become ignited by the burning mixture.

The pre-mixing section (20) is an annular duct (33) having walls (15,16) which extend in the direction of the axis of the chamber and are straight in that direction though slightly convergent. The arrangement favors vaporization in the duct without auto-ignition.

A modification describes a cooling system for the grill (22).

5 Claims, 10 Drawing Figures

Fig. 7
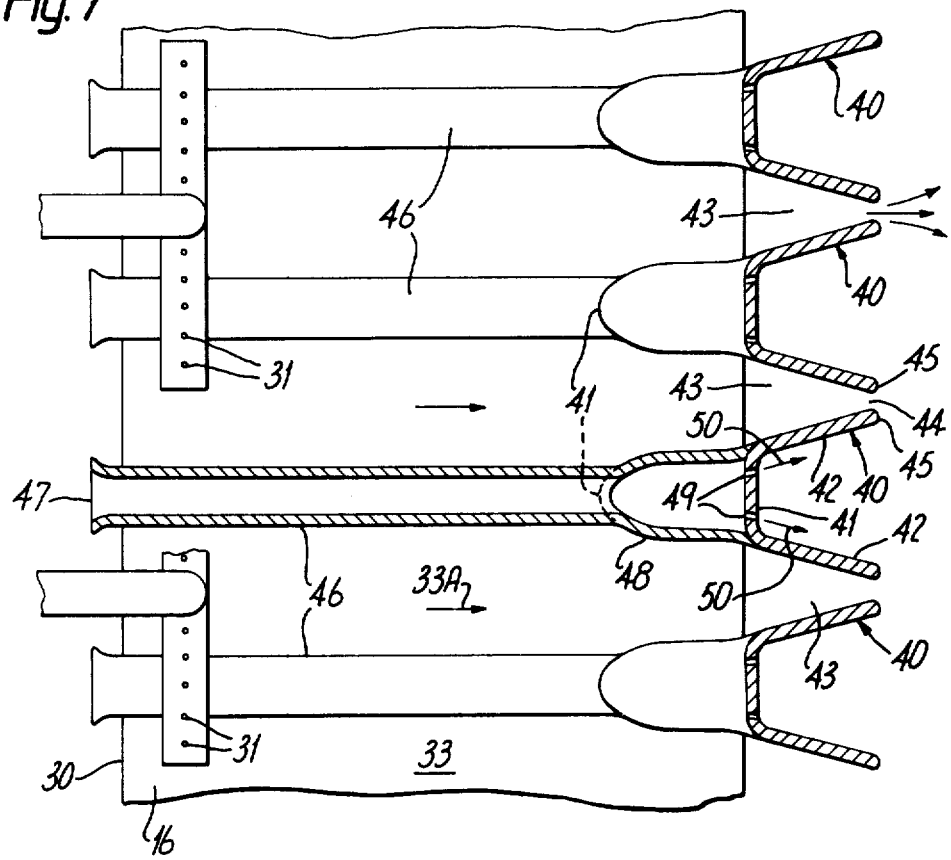
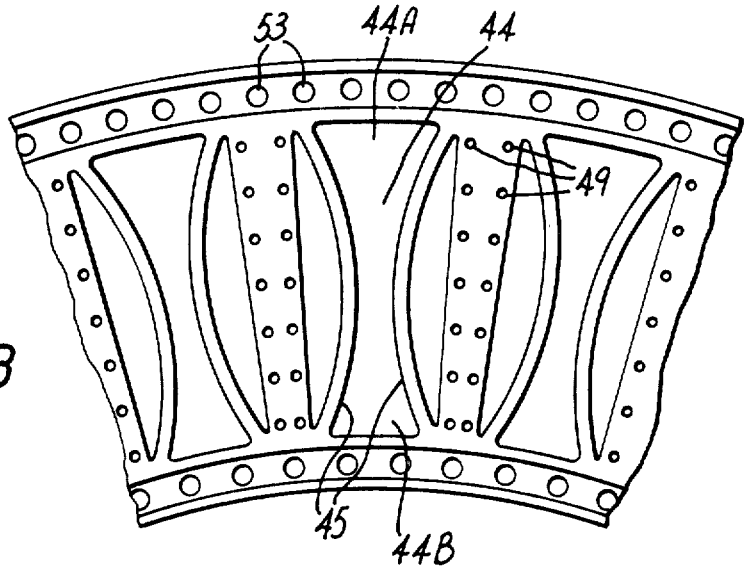
Fig. 8

GAS TURBINE ENGINE

This application is related to copending of application Ser. No. 5,242 filed Jan. 22nd, 1979 and now U.S. Pat. No. 4,249,373.

This invention relates to gas turbine engines and is concerned with reducing the emission of nitrogen oxide from the combustion system of such engines.

It is known that nitrogen oxide emission during combustion of a mixture of air and liquid hydrocarbon fuel is a function of the combustion temperature. It has therefore been suggested to burn relatively lean such mixtures, i.e. mixtures having a less than stoichiometric fuel content. This lowers the combustion temperature and thus the nitrogen oxide emission. It is also known that such "cool" burning requires a good degree of vapourisation of the fuel before combustion is allowed to take place because, to the extent that droplets of liquid fuel are present in the mixture, the burning at the surface of such droplets amounts to burning of stoichiometric mixture and as such takes place at temperatures favouring high nitrogen oxide emission. It has therefore been suggested to provide a combustion chamber with a pre-mixing section in which a lean air-fuel mixture can be taken to a significant degree of vapourisation before the mixture issues from that section into a main section where the mixture is ignited and burnt. However, considerable difficulty has been experienced with premature ignition of the mixture in the pre-mixing section. It is an object of this invention to overcome or reduce this difficulty.

It is also known to provide said combustion chamber with a pilot section having an output of burning gases which mix with and ignite the fresh mixture from the pre-mixing section. It is a further object of this invention to provide an improvement in the mixing of the pilot gases with the fresh mixture with a view to reducing the axial length of the main section and in this way compensate for the inevitable increase in combustion time required for efficient burning of lean mixture.

According to this invention there is provided a gas turbine engine having an annular combustion chamber comprising annular walls extending in the direction of the axis of the chamber and defining an annular pre-mixing duct having at one axial end an annular air inlet and having at the other axial end an annular array of outlets, means for introducing fuel into the duct at the inlet end thereof thereby to generate within the duct an air-fuel mixture, walls defining a main section of the chamber situated in flow series with the duct, the latter walls being concentric with the duct and lying in positions respectively radially inwardly and outwardly of the duct thereby defining a width greater than that of the duct, the outlets being directed to discharge the mixture from the duct in directions radially inwardly and outwardly across the width of the main section, and means for igniting the mixture so introduced into the main section.

The axially directed walls of the duct allow high uniform flow velocities therethrough and in this way provide conditions avoiding premature ignition. The arrangement of the main section walls in positions radially inwardly and outwardly of the duct, and the directing of the fresh mixture from the duct radially inwardly and outwardly across the width of the main section, provide conditions ensuring substantially equal treatment of all parts of the mixture and full use of all parts of the main section. This in turn reduces the axial length necessary for the main section.

The present invention is further concerned with the transfer of the mixture from the pre-mixing section into the main section of the chamber. This transfer may be effected through a grill at the downstream end of a duct defining the pre-mixing section. The purpose of the grill is inter alia to provide a flame trap intended to separate the fresh from the burning mixture and to avoid flame migrating upstream into the pre-mixing duct. The grill has outlets defined between spaced apart grill members which divide the flow through the pre-mixing section into separate streams entering the main section. At their sides facing the main section the grill members are subject to the heat in the latter section. This may lead to destructive oxidation of the grill members.

To overcome or reduce the latter difficulty, there may be provided, according to this invention, gas turbine engine comprising an air compressor; a combustion chamber comprising a pre-mixing section arranged to receive air flow from the compressor, means for discharging fuel into the pre-mixing section thereby to create an air-fuel mixture therein, a main section, and a grill through which said mixture is dischargeable from the pre-mixing section into the main section; and wherein the grill comprises an annular array of baffles arranged in circumferentially spaced-apart pairs, the two baffles of each pair have a common portion from which the two baffles diverge in the direction from the pre-mixing to the main section, and adjacent said pairs are spaced apart to define therebetween flow passages from the pre-mixing to the main section.

The latter provisions result in that the flow from the pre-mixing into the main section is divided by the common portion of each baffle pair so that no stagnation region, or an acceptably small such region is formed at the upstream end of each pair of said divergent baffles.

The gas turbine engine according to this invention may comprise cooling air ducts having inlets arranged to receive air flow from said compressor but being clear of any fuel supply and having outlets directed into the space between the baffles of each said pair of baffles thereby to cool the surfaces of the baffles facing the main section.

Examples of a gas turbine engine according to this invention will now be described with reference to the accompanying drawings wherein:

FIG. 7 is a section on the line III—III in FIG. 5;

FIG. 8 is a view in the direction of the arrow VIII in FIG. 5;

Figure 1:
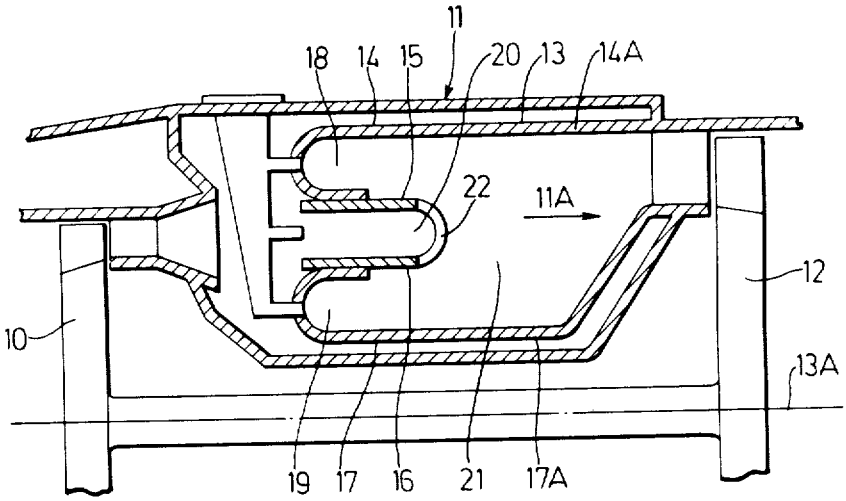
FIG. 1 is a diagrammatic sectional elevation of a part of the engine.

Referring to FIG. 1, there is shown a gas turbine engine comprising in flow series a compressor 10, a combustor 11 and a turbine 12 connected to drive the compressor. The mean direction of flow through the combustor is indicated by an arrow 11A.

The combustor comprises a combustion chamber 13 arranged annularly about an axis 13A and having two walls 14,15 defining between them an annular, radially outer, pilot section 18 of the chamber 13 and two walls 16,17 defining between them an annular, radially inner, pilot section 19 of the chamber 13. The walls 15,16 define between them an annular pre-mixing section 20, the chamber 13 has walls 14A, 17A being continuations of the walls 14,17 and defining a common or main section 21 of the chamber in which flow from the pre-mixing section 20 is mixed with flow from the pilot sections 18,19. The pre-mixing section is connected to the main section through a distribution grill 22.

The arrangement of the four sections 18 to 21 is intended to provide a combustion system in which the emission of nitrogen oxide is suppressed while at the same time ensuring stable combustion. Suppression of nitrogen oxide emission is achieved by the preparation of a lean, substantially vapourised, combustible mixture in the premixing section 20. Such a mixture has the low combustion temperature required for low nitrogen oxide concentration. Auto-ignition of this mixture is avoided by providing conditions of laminar flow in the pre-mixing section. Flame from the pilot sections and fresh mixture from the pre-mixing section mix in the main section for ignition of the fresh mixture and completion of burning of the pilot mixture. The pilot sections, where relatively richer mixture is burnt in conditions of recirculatory flow, provide the stability of combustion which the pre-mixed mixture does not have because of its lean composition. The distribution grill 22 is designed to ensure a uniform distribution of the flow from the pre-mixing section across the flow from the pilot sections.

Figure 2:
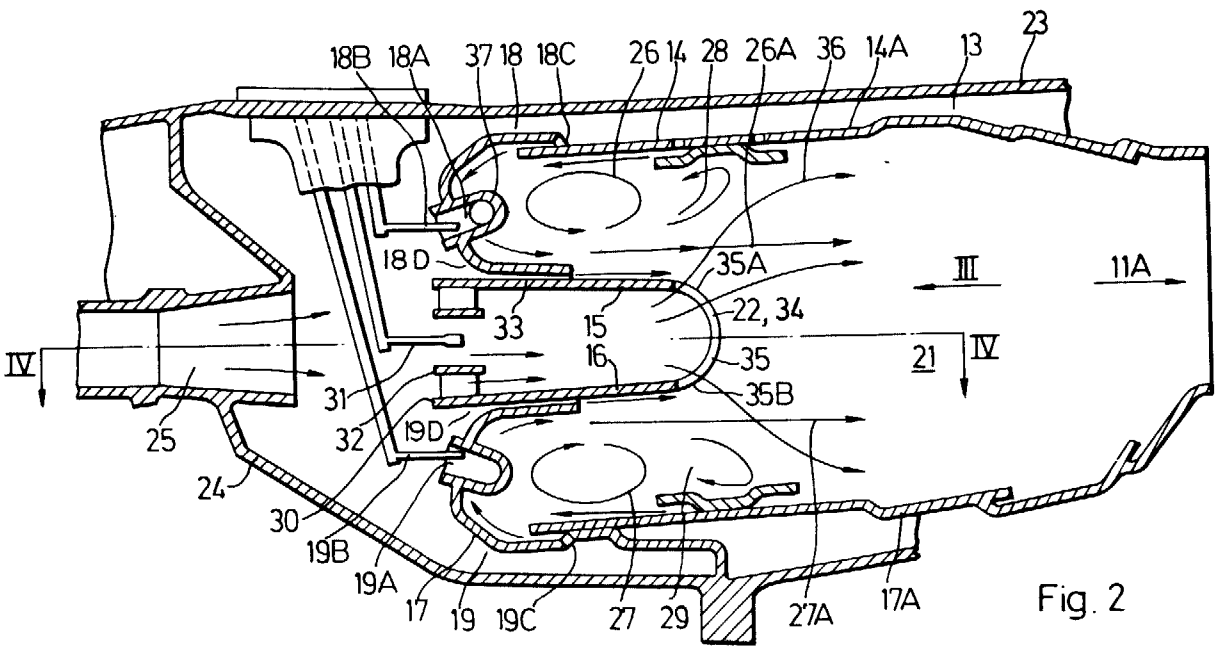
FIG. 2 is an enlarged detail of FIG. 1.
Figure 3:
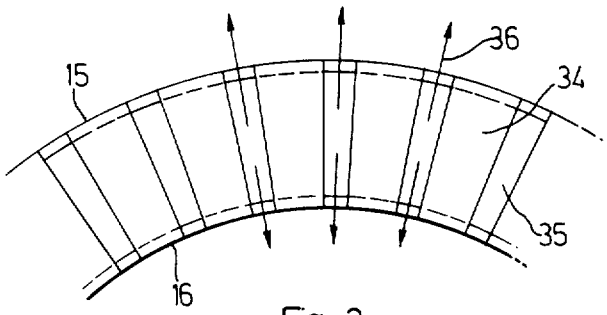
FIG. 3 is a view in the direction of the arrow III in FIG. 2 further enlarged.
Figure 4:
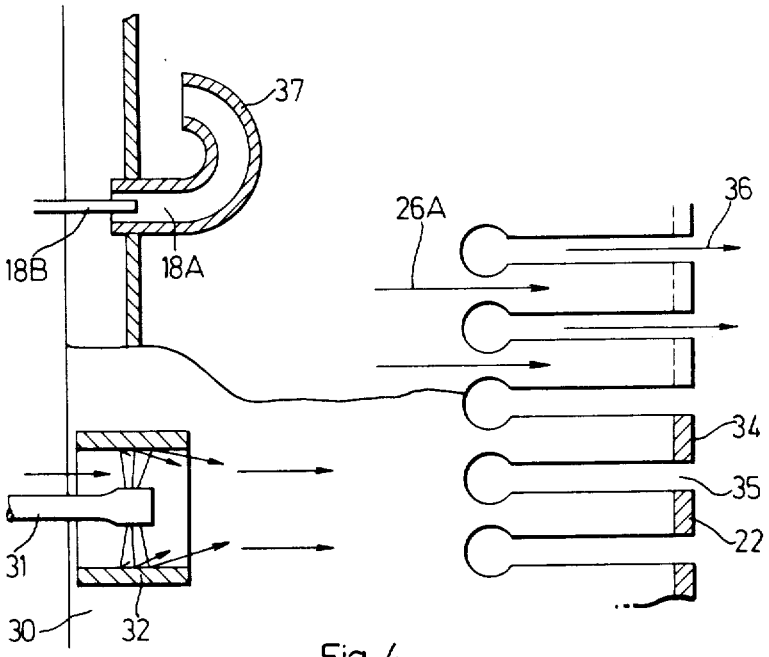
FIG. 4 is a section on the line IV—IV in FIG. 2 further enlarged.

Referring now to FIGS. 2 to 4, the chamber 13 is surrounded by an air jacket 23 including at its upstream end a diffuser 24 for air leaving the compressor 10 through an annular duct 25.

The pilot section 18 has air inlets 18C provided in the wall 14 and so directed that air entering the section 18 through those inlets forms a vortex 26 thereby to provide the recirculation of flow which provides the burning mixture with the sheltered residence necessary for stable combustion over a wide range of fuel flow. The fuel itself is introduced through inlets 18B distributed annularly around the pilot section and being nozzles each supplying a spray of fuel into a respective air inlet 18A. The resulting mixture enters the pilot section through a duct 37 in which that mixture is partly vapourised. Substantial vapourisation of the mixture is not intended in the duct 37. The inlets 18C also provide cooling flow along the wall 14. The wall 15 is cooled by a cooling flow through inlets 18D. An igniter is provided for igniting the combustible mixture in the pilot section on starting of the engine.

The pilot section 19 has inlets 19A, 19B for fuel and air, inlets 19C for creating a vortex 27, and a cooling air inlet 19D all corresponding to the inlets 18A,18B, 18C, 18D of the section 18. However, the arrangement is such that the vortices 26,27 are of opposite hand and so tht the local flow of the vortices along the walls 15,16 takes place in the downstream direction, i.e. toward the main section 21. Outlets 28,29 of the pilot sections 18, 19 are defined approximately between the grill 22 and the walls 14,17.

The pre-mixing section 20 has an annular air inlet 30. Fuel is introduced into the inlet 30 by an annular series of inlets 31 being nozzles which direct jets of fuel against a respective sleeve 32 surrounding the nozzle. The walls 15,16 form between them a smooth slightly convergent duct 33 of substantial length ending at the grill 22 facing the main section 21. The air-fuel mixture introduced by the inlets 30,31 is of combustible proportions and is intended to vapourise to a significant extent in the duct 33 so as to eliminate elements of liquid fuel. This is achieved by generating a very fine spray by means of the nozzles 31 and sleeves 32, and by making the duct sufficiently long for substantial vapourisation to occur under the relatively high temperature of the compressed air. This process has the danger that the vapour in the duct 33 may prematurely ignite either due to the high temperature of the air or due to flame migrating from the main section through the grill 22 and along slowly moving at the walls 15,16. Such auto-ignition and boundary layer burning would very quickly melt and destroy the walls 15,16 of the duct and are a critical condition of success of pre-mixing.

To avoid burning in the duct 33 the flow through the duct should be as nearly as possible laminar, i.e. free from turbulent regions in which velocity can reduce and flame become established. Secondly the flow velocity in the duct 33 should be higher than the propagation speed of flame in the mixture so that any flame that should occur is rapidly swept downstream into the main section. These conditions are achieved by arranging the walls 15,16 to extend substantially in the direction of the axis 11A, and to be straight and continuous in that direction, so that the local flow separations occurring in curved ducts, and more likely to occur at high flow velocities, are avoided. Further, the duct 33 is arranged for its annular inlet 30 to directly confront, i.e. be on the same mean diameter as the annular compressor outlet 25. This ensures that compressor delivery air becomes available to the duct 33 with a minimum of turbulence. Further again, the duct 33 is made slightly tapered toward the grill 22, i.e. at least one of the walls 15,16 is on the sides of a cone centred on the axis 13A, the other one of the walls being either cylindrical or being also conical but in the opposite sense to the cone of the one wall. The tapered arrangement of smooth walls favours a corresponding (increase in flow) velocity toward the main section and a corresponding suppression of slow boundary layer flow. The danger of flame migrating from the main section into the duct 33 is correspondingly reduced. Lastly, the duct should not be longer than is desirable for a satisfactory level of vapourisation since any undue length increases the danger of auto-ignition.

The grill 22 is defined by an end wall 34 closing the downstream end of the duct except for openings 35 provided in that wall. The wall 34 is curved to be convex as seen from the main section and may be regarded as defining one half of a toroidal shape generated about the axis 13A. The openings 35 are elongate in the radial direction, having regard to the axis 13A, and face the main section 21 over a half-circle so that the openings 35 have ends 35A, 35B respectively facing radially across the outlets 28,29 of the pilot sections 18,19. As a result the flow from each opening 35 is in the form of a fan 36 lying in a plane through the axis 13A, and extending substantially completely across between the walls 14,17 and of course across the outlets 28,29 of the pilot sections. Thwe fans 36 therefore penetrate the flows, indicated 26A, 27A shed by the vortices 26,27, of the pilot sections. This results in intimate mixing between the burning pilot mixture and the fresh mixture from the pre-mixing section.

The grill 22 is also a flame trap inasmuch as flame from the main section will tend not to penetrate the flow restrictions constituted by the openings 35.

The relative mixture strengths of the pilot and pre-mixed flows are such that the mixture eventually established in the main section is sufficiently lean, say 30–40% of the stoichiometric mixture, to have a burning temperature sufficiently low for significant nitrogen oxide suppression. A certain proportion of the fuel will inevitably reach the main section in droplet form, both from the pilot or from pre-mixing sections, and will tend to burn with a locally high nitrogen oxide emission. But overall such emission is reduced. The pre-mixed mixture may absorb about 50% of the compressor delivery air and itself have a mixture strength of 50% of stoichiometric while the pilot section have a mixture strength of 70–100% of stoichiometric.

Figure 5:
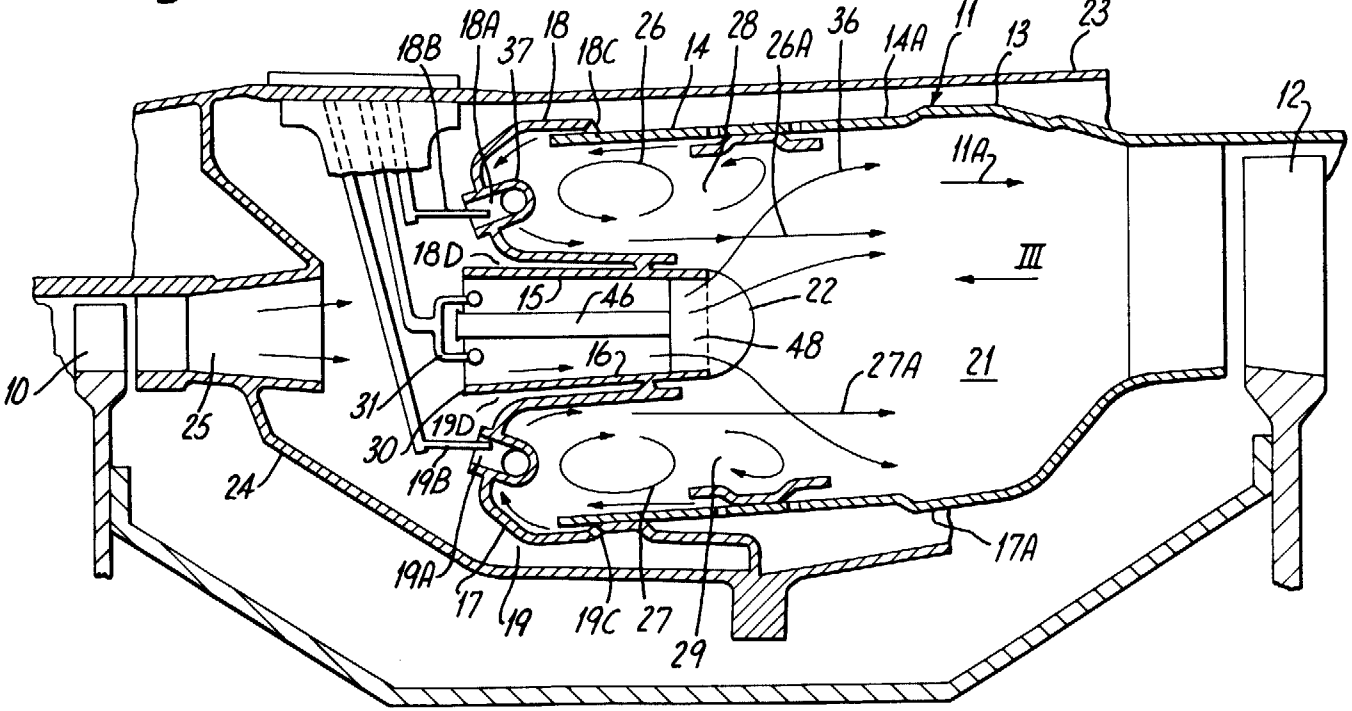
FIG. 5 is a view similar to FIG. 1 and shows a modification.

Referring to FIG. 5, there is shown a gas turbine engine comprising in flow series a compressor 10, a combustor 11 and a turbine 12 connected to drive the compressor. The mean direction of flow through the combustor is indicated by an arrow 11A.

The combustor comprises a combustion chamber 13 arranged annularly about an axis 13A and having two walls 14,15 defining between them an annular, radially outer, pilot section 18 of the chamber 13 and two walls 16,17 defining between them an annular, radially, inner pilot section 19 of the chamber 13. The walls 15,16 define between them an annular pre-mixing section 20. The chamber 13 has walls 14A, 17A being continuations of the walls 14,17 and defining a common or main section 21 of the chamber 13. The pre-mixing section is connected to the main section through a grill 22.

The arrangement of the four sections 18 to 21 is intended to provide a combustion system in which the emission of nitrogen oxide is suppressed while at the same time ensuring stable combustion. Suppression of nitrogen oxide emission is achieved by the preparation of a lean, substantially vapourised, combustible mixture in the pre-mixing section 20. Such a mixture has the low combustion temperature required for low nitrogen oxide concentration. Auto-ignition of this mixture is avoided by providing conditions of laminar flow in the pre-mixing section. Flame from the pilot sections and fresh mixture from the pre-mixing section mix in the main section for ignition of the fresh mixture and completion of burning of the pilot mixture. The pilot sections, where relatively richer mixture is burnt in conditions of recirculatory flow, provide the stability of combustion which the pre-mixed mixture does not have because of its lean composition. The grill 22 is designed to ensure a uniform distribution of the flow from the pre-mixing section across the flow from the pilot sections.

The chamber 13 is surrounded by an air jacket 23 including at its upstream end a diffuser 24 for air leaving the compressor 10 through an annular duct 25.

The pilot section 18 has air inlets 18C provided in the wall 14 and so directed that air entering the section 18 through those inlets forms a vortex 26 thereby to provide the recirculation of flow which provides the burning mixture with the sheltered residence necessary for stable combustion over a wide range of fuel flow. The fuel itself is introduced through inlets 18B distributed annularly around the pilot section and being nozzles each supplying a spray of fuel into a respective air inlet 18A. The resulting mixture enters the pilot section through a duct 37 in which that mixture is partly vapourised. Substantial vapourisation of the mixture is not intended in the duct 37. The inlets 18C also provide cooling flow along the wall 14. The wall 15 is cooled by a cooling flow through inlets 18D. An igniter (not shown) is provided for igniting the combustible mixture in the pilot section on starting of the engine.

The pilot section 19 has inlets 19A,19B for fuel and air, inlets 19C for creating a vortex 27, and a cooling air inlet 19D, all corresponding to the inlets 18A,18B, 18C,18D of the section 18. However, the arrangement is such that the vortices 26,27 are of opposite hand and so that the local flow of the vortices along the walls 15,16 takes place in the downstream direction, i.e. toward the main section 21. Outlets 28,29 of the pilot sections 18,19 are defined approximately between the grill 22 and the walls 14,17.

The pre-mixing section 20 has an annular air inlet 30. Fuel is introduced into the inlet 30 by an annular series of inlets or nozzles 31 which direct jets of fuel into the air entering the section 20. The walls 15,16 form between them a smooth slightly convergent duct 33 of substantial length ending at the grill 22 facing the main section 21. The air-fuel mixture introduced by the inlets 30,31 is of combustible proportions and is intended to vapourise to a significant extent in the duct 33 so as to substantially eliminate elements of liquid fuel. This is achieved by generating a very fine spray by means of the nozzles 31, and by making the duct sufficiently long for substantial vapourisation to occur under the relatively high temperature of the compressed air. This process has the danger that the vapour in the duct 33 may prematurely ignite either due to the high temperature of the air or due to flame migrating from the main section 21 through the grill 22 and along slowly moving boundary layer at the walls 15,16. Such auto-ignition and boundary layer burning would very quickly melt and destroy the walls 15,16 of the duct and are a critical condition of success of premixing.

To avoid burning in the duct 33 the flow through the duct should be as nearly as possible laminar, i.e. free from turbulent regions in which velocity can reduce and flame become established. Secondly the flow velocity in the duct 33 should be higher than the propagation speed of flame in the mixture so that any flame that should occur is rapidly swept downstream into the main section. These conditions are achieved by arranging the walls 15,16 to extend substantially in direction of the axis 13A, and to be straight and continuous in that direction, so that the local flow separations occurring in curved ducts, and more likely to occur at high flow velocities, are avoided. Further, the duct 33 is arranged for its annular inlet 30 to directly confront, i.e. be on the same mean diameter as the annular compressor outlet 25. This ensures that compressor delivery air becomes available to the duct 33 with a minimum of turbulence. Further again, the duct 33 is made slightly tapered toward the grill 22, i.e. at least one of the walls 15,16 is at least partially on the sides of a cone centred on the axis 13A, the other one of the walls being either cylindrical or being also conical but in the opposite sense to the cone of the one wall. The tapered arrangement of smooth walls favours a corresponding increase in flow velocity toward the main section and a corresponding reduction of slow boundary layer flow. The danger of flame migrating from the main section into the duct 33 is correspondingly reduced. The duct should not be longer than is desirable for a satisfactory level of vapourisation since any undue length increases the danger of auto-ignition. Lastly, the grill 22, in addition to its purpose of distributing the pre-mixture, also serves as a flame trap in as much as the flow restriction consituted by the grill resists penetration by flame from the main section 21.

Figure 6:
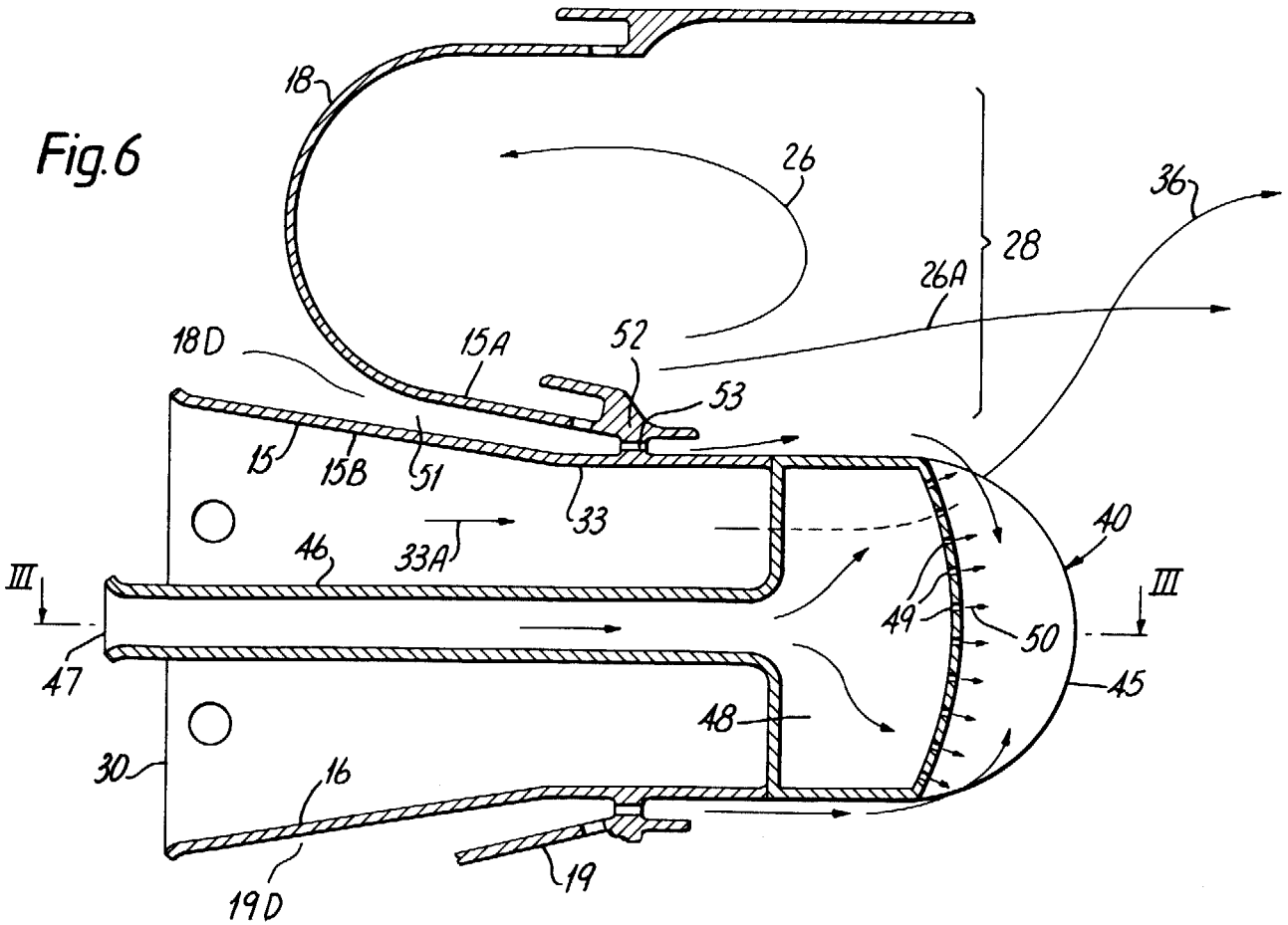
FIG. 6 is an enlarged detail of FIG. 5.

Referring now more particularly to FIGS. 5 to 9, the grill 22 is constituted by an annular array of baffles 42 connected to the downstream ends of the walls 15,16 in position therebetween. The baffles 42 are arranged in pairs each defining a channel 40 wherein the two baffles of each channel have a common or upstream portion 41 from which the two baffles 42 diverge in the direction from the pre-mixing section 20 to the main section 21. The upstream portion 41 constitutes a flow divider at which no, or only an acceptably small amount of, flow stagnation can occur. The dividing line nominally defined by the flow divider is radial in respect to the annular array of baffles i.e. radial in respect of the axis 13A. The sense of divergence of the baffles is accordingly circumferential. The channels 40 are spaced apart circumferentially and define flow passages 43 between adjacent such channels. In view of the divergence of the baffles of each channel 40 the flow passages 43 are convergent. Each passage 43 has a radially elongate outlet 44 (see especially FIGS. 8,9) defined by the free edges, 45, of the baffles 42. The edges 45 are curved to be convex as seen from the main section 21 and may be regarded as lying on one half of a toroidal shape generated about the axis 13A. Each outlet 44 therefore faces the main section 21 over a half-circle (FIGS. 6,9) and so as to have ends 44A,44B (FIGS. 5,6,9) facing radially across the outlets 28,29 of the pilot sections 18,19 (FIG. 6). As a result the flow from each outlet 44 is in the form of a fan 36 (FIGS. 5,6) lying in a plane through the axis 13A, and extending substantially completely across between the walls 14,17 and of course across the outlets 28,29 of the pilot sections. The fans 36 therefore penetrate the flows, indicated 26A,27A, shed by the vortices 26,27 of the pilot sections. This results in intimate mixing between the burning pilot mixture and the fresh mixture from the pre-mixing section.

In view of the convergence of the passages 43 and of the half-round shape of the edges 45, the elongate outlets 44 are wider at their ends, 44A,44B, than at their mid-length. The mass flow from the outlets 44 is therefore biased into the radial direction as required for distribution of flow across the chamber and for mixing with the pilot gases.

Each channel 40 is connected to a cooling air supply being a tube 46 extending axially through the duct 20 and having an inlet 47 upstream of the fuel nozzles 31 so that only unfuelled air can enter the tube 46. At its downstream end the tube 46 terminates in a chamber 48 lying at the upstream portion 41 of the channel 40. The chamber 48 serves to distribute the air over the full radial length of the upstream portion and is connected to the inside, i.e. the downstream side, of the channel 40 by a series of holes 49 in the upstream portion 41. Latter holes are positioned to direct jets of air 50 (FIGS. 7,9) along the sides of the baffles 42 remote from the passages 43. Thus, each baffle 42 is cooled at its one side by fresh mixture and at its other side by air. The upstream portion 41 is cooled at least at its upstream side by the air in the chamber 48. In this way the channels 40, i.e. the metal which must necessarily be provided to define the passages 43, are protected from the heat in the main section 21.

The wall 15 comprises spaced apart radially inner and outer parts 15A,15B (FIGS. 6,8,9) defining between them an annular channel 51 fed with air from the inlet 18D. At its downstream end the channel 51 is interrupted by a partition 52 by which the wall parts 15A,15B are secured together. The partition 52 has holes 53 through which the air passes over the radially outer ends of the channels 40 to provide further cooling. A similar arrangement applies to the wall 16. The air from the holes 53 tends to flow into the space between the two baffles of the respective channels 40 further adding to the cooling effect.

Figure 10:
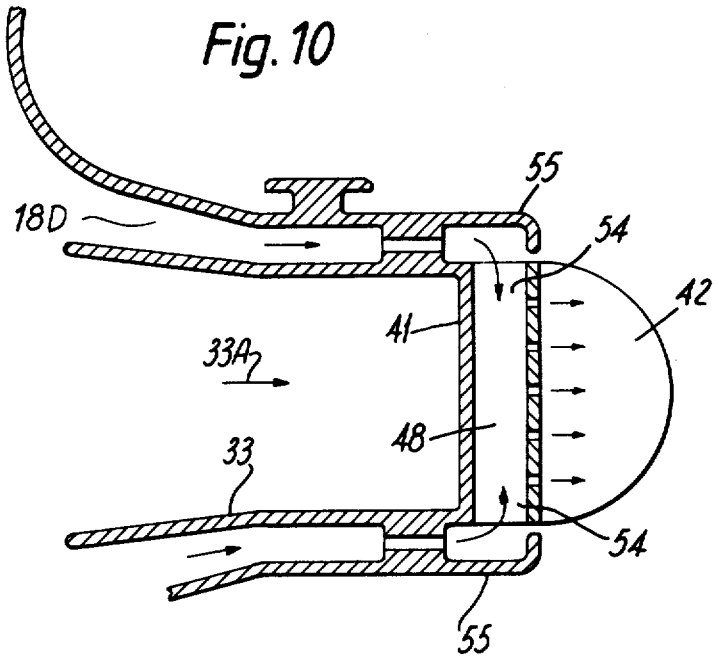
FIG. 10 is a view similar to FIG. 5 and shows a further modification.
Figure 9:
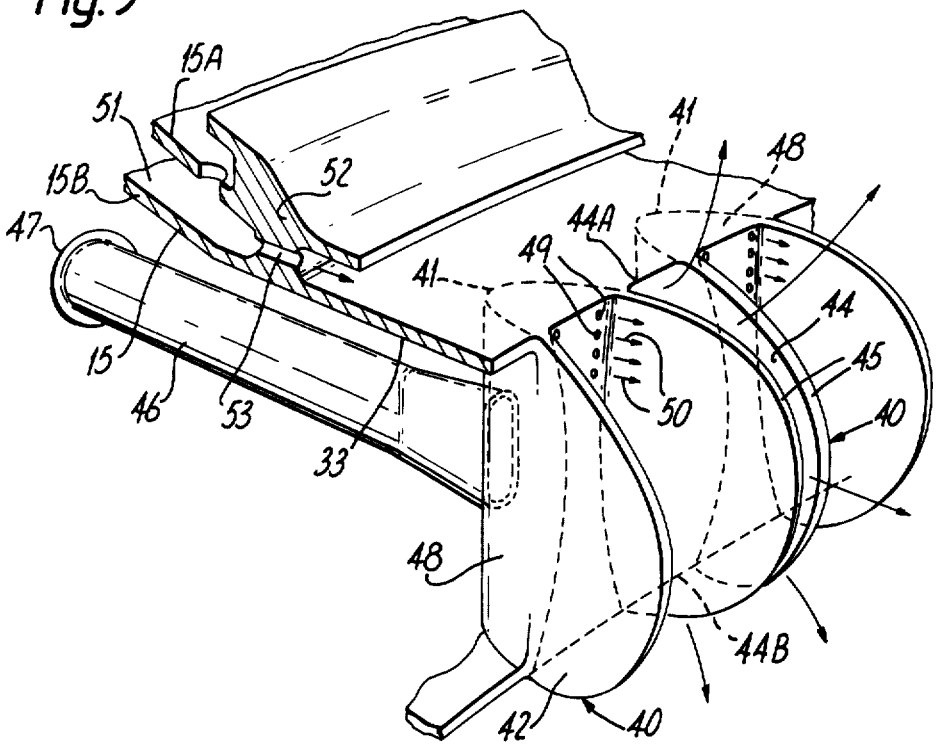
FIG. 9 is a perspective view of a part of FIG. 5.

In a modification (FIG. 10) the tubes 46 are dispensed with and the chambers 48 are supplied wholly by air from the holes 53, the air entering the chambers 48 through inlets 54 in their radially outer ends. A shroud 55 at the downstream end of the wall part 15B directs the air from the holes 52 into the adjacent inlets 53. A similar arrangement is provided at the radially inner ends of the chambers 48.

I claim:

1. A gas turbine engine comprising an air compressor, a combustion chamber comprising a pre-mixing section arranged to receive air flow from the compressor and having spaced apart walls, means for discharging fuel into the pre-mixing section thereby to creat an air-fuel mixture therein, a main section arranged downstream of the pre-mixing section, an array of baffles arranged in spaced-apart pairs, the two baffles of each pair having a common portion from which the two baffles diverge in the direction from the pre-mixing to the main section, adjacent said pairs being spaced apart to define flow passages therebetween, and cooling air duct means having inlets arranged to receive air flow from said compressor but being clear of any fuel supply and having outlets directed into a space defined between the baffles of each said pair of baffles thereby to cool the surfaces of the baffles facing the main section.

2. A gas turbine engine according to claim 1 wherein each said common portion is elongate between said spaced apart walls of the pre-mixing section, and said cooling air duct means include a chamber provided at said common portion of the baffles and extending over the length thereof, and means defining holes leading from the chamber and being open to a surface of the baffles facing said main section of the combustion chamber.

3. A gas turbine engine according to claim 2 wherein said duct means comprise in respect of each chamber a duct extending from the chamber through the pre-mixing section to a position upstream of said fuel discharge means.

4. A gas turbine engine according to claim 2 wherein said duct means are arranged at the exterior of a said wall defining the pre-mixing section, and each said chamber has an inlet open to said duct means.

5. A gas turbine engine according to claim 1 wherein said baffles each have an edge defining the downstream end of the baffle and being curved in the sense of being convex as seen in the direction from said main section to said pre-mixing section, each of said flow passages being convergent by virtue of said diverging of the baffles of said pairs, the flow passage terminating at an outlet defined by the convex edges of said two baffles, said outlet being curved in accordance with the curving of said edges and said outlet being elongate in the direction between said walls and being wider at its ends by virtue of the curving of said edges and the convergence of the flow passage.

* * * * *